US010724409B2

(12) United States Patent
Kumar et al.

(10) Patent No.: US 10,724,409 B2
(45) Date of Patent: Jul. 28, 2020

(54) MUFFLER VALVE DEVICE FOR VEHICLE

(71) Applicants: Hyundai Motor Company, Seoul (KR); Kia Motors Corporation, Seoul (KR)

(72) Inventors: Chintala Chytanya Kumar, Hyderabad (IN); Man Seok Oh, Yongin-si (KR); Mukesh Reddy Mitta, Hanamkonda (IN); Kiran V, Hyderabad (IN)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 370 days.

(21) Appl. No.: 15/850,607

(22) Filed: Dec. 21, 2017

(65) Prior Publication Data

US 2019/0120102 A1 Apr. 25, 2019

(30) Foreign Application Priority Data

Oct. 25, 2017 (IN) ..... 201711037738

(51) Int. Cl.
*F01N 1/16* (2006.01)
*F01N 1/08* (2006.01)

(52) U.S. Cl.
CPC ..... *F01N 1/163* (2013.01); *F01N 1/083* (2013.01); *F01N 1/089* (2013.01); *F01N 1/16* (2013.01); *F01N 1/166* (2013.01); *F01N 2290/00* (2013.01); *F01N 2390/00* (2013.01); *F01N 2390/06* (2013.01); *F01N 2470/18* (2013.01)

(58) Field of Classification Search
CPC . F01N 1/163; F01N 1/16; F01N 1/166; F01N 1/083; F01N 1/089; F01N 2290/00; F01N 2390/00; F01N 2390/06; F01N 2470/18
USPC ..... 181/241, 254
See application file for complete search history.

(56) References Cited

U.S. PATENT DOCUMENTS 4,903,486 A * 2/1990 Finkle ..... F01N 1/165 181/236
5,435,347 A * 7/1995 Gillingham ..... F02D 9/06 137/599.09
6,554,099 B2 * 4/2003 Uegane ..... B60K 13/04 181/275
7,487,857 B2 * 2/2009 Wolf ..... G10K 11/22 181/229
9,644,544 B2 * 5/2017 Snow ..... F02D 9/04
(Continued)

FOREIGN PATENT DOCUMENTS

JP 11036844 A * 2/1999 ..... F01N 1/166
JP 2007291944 A * 11/2007 ..... F01N 1/166
JP 2007291946 A * 11/2007 ..... F01N 1/166
(Continued)

*Primary Examiner* — Jeremy A Luks
(74) *Attorney, Agent, or Firm* — Morgan, Lewis & Bockius LLP

(57) ABSTRACT

A muffler valve device for a vehicle may include a chamber fixed at a surface of the wall, a guide rod provided in the chamber and attached at the surface of the wall, a fixing member attached at one end portion of the guide rod and fixing the chamber, a valve disposed slidably on the guide rod between the surface of the wall and the fixing member, and an elastic member located between the valve and the fixing member to provide an elastic force to the valve.

10 Claims, 10 Drawing Sheets

(56) References Cited

U.S. PATENT DOCUMENTS

| | | | | |
|---|---|---|---|---|
| 9,695,719 | B2 * | 7/2017 | Arai | F01N 1/084 |
| 2006/0249328 | A1 * | 11/2006 | Ichikawa | F01N 1/08<br>181/254 |

FOREIGN PATENT DOCUMENTS

| | | | |
|---|---|---|---|
| JP | 2007-327391 | A | 12/2007 |
| KR | 101272951 | B1 * | 6/2013 |

* cited by examiner

MUFFLER VALVE DEVICE FOR VEHICLE

CROSS-REFERENCE TO RELATED APPLICATION

The present application claims priority to Indian Patent Application No. 201711037738 filed in the Indian Patent Office on Oct. 25, 2017, the entire contents of which is incorporated herein for all purposes by this reference.

BACKGROUND OF THE INVENTION

Field of the Invention

The present invention relates to a muffler valve device for a vehicle. More particularly, the present invention relates to a muffler valve device for a vehicle, more particularly, to adjust flowing of exhaust gas according to pressure of the exhaust gas exhausted from an engine to enhance the engine output and reduce booming noise and flow-induced noise.

Description of Related Art

Generally, an exhaust apparatus for a vehicle is for exhausting the high temperature and high pressure exhaust gas to outside through exhaust stroke. The exhaust apparatus includes an exhaust manifold gathering combustion gas exhausted from each cylinder, an exhaust pipe inducing the exhausted gas to an exit located rear portion of the vehicle, and a muffler reducing exhaust sound.

Here, the exhaust manifold is a component which gathers exhaust gas exhausted from each cylinder of a multi-cylinder engine. The exhaust pipe is a passage inducing the exhaust gas exhausted from the exhaust manifold to the exit located rear portion of the vehicle. The exhaust pipe is divided by a few pipes since a catalyst or a muffler is disposed at the exhaust pipe.

This exhaust apparatus makes explosion sound when the exhaust gas from the engine is directly released to outside, therefore the exhaust sound is reduced by the muffler. The sound elimination method by mounting the muffler at the exhaust pipe and applying sound wave reflection between internal walls of the muffler or resonance phenomenon is mostly used.

Here, a variable valve is disposed in the vehicle muffler such that the flowing of the exhaust gas is adjusted according to the pressure of the exhaust gas inflowing into inside for reducing exhaust gas booming sound.

However, although the conventional muffler obtains effect of reducing the booming sound by mounting the variable valve opens and closes according to the pressure of the exhaust gas, the variable valve includes a housing, a gate, a gate rotation shaft, a spring and a protrusion portion etc., therefore the structure is complex, and manufacturing cost according to increasing of components is increased, and a weight is increased.

The information disclosed in the present Background of the Invention section is only for enhancement of understanding of the general background of the invention and may not be taken as an acknowledgement or any form of suggestion that the present information forms the prior art already known to a person skilled in the art.

BRIEF SUMMARY

Various aspects of the present invention are directed to providing a muffler valve device for a vehicle which is provided in the muffler and adjusts flowing of exhaust gas according to pressure of the exhaust gas exhausted from an engine to enhance the engine output and reduce booming noise and flow-induced noise, therefore the structure becomes simple and manufacturing cost may be reduced.

A muffler valve device for a vehicle according to an exemplary embodiment of the present invention is a muffler valve device improving output of an engine, reducing a booming sound, and minimizing flow-induced noise, which is disposed at one of a plurality of walls provided at the muffler which exhaust gas inflows through an inlet pipe and outflows the inflowed exhaust gas through a tail pipe, includes a chamber fixed at a surface of the wall, a guide rod provided in the chamber and attached at the surface of the wall, a fixing member attached at one end portion of the guide rod and fixing the chamber, a valve disposed slidably on the guide rod between the surface of the wall and the fixing member, and an elastic member located between the valve and the fixing member to provide an elastic force to the valve.

The chamber may have at least one exhaust gas exhausting hole formed on an external circumference between the fixing member and the valve.

The respective exhaust gas exhausting hole may be formed spaced at a predetermined interval along the external circumference of the chamber.

The chamber may be formed as a hollow cylinder shape, and the guide rod may penetrate a center of the hollow of the chamber in a lengthwise direction of the chamber.

The elastic member may include a coil spring of which one end portion is supported by the fixing member and the other end portion is supported by the valve.

The elastic member may be formed of Inconel material.

The fixing member may be formed as a plurality of perpendicular rods extending toward outside on a center of a portion on which the guide rod is attached.

An end portion of the fixing member may be formed as being bent toward the chamber and the elastic member.

A portion of the fixing member may fix the chamber, and the other portion may fix the elastic member.

The muffler valve device according to an exemplary embodiment of the present invention may further include a plate attached on the valve to fix the elastic member to the valve and disposed slidably on the guide rod.

The plate may be shaped as a plurality of perpendicular rods extending toward outside on a center of a hole into which the guide rod is inserted.

An end portion of the plate may be formed as being bent toward the valve to fix the elastic member.

The chamber, the guide rod, the fixing member, the valve and the plate may be formed of stainless steel material.

According to an exemplary embodiment of the present invention, flowing of exhaust gas according to pressure of the exhaust gas exhausted from an engine is adjusted to enhance the engine output and reduce booming noise and flow-induced noise, therefore the structure becomes simple and manufacturing cost may be reduced.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
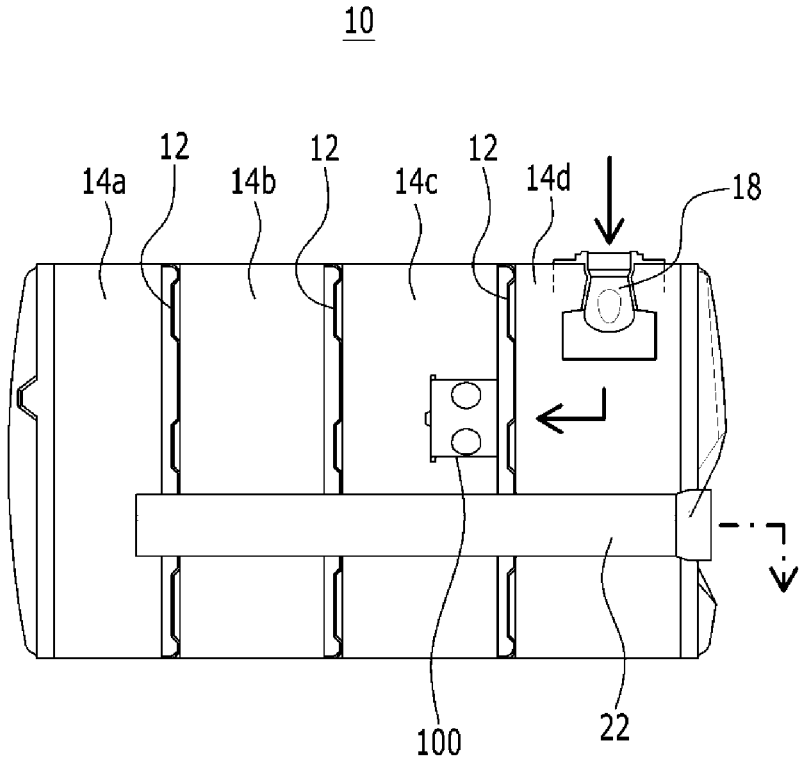
FIG. 1 is a schematic drawing a muffler including a muffler valve device for a vehicle according to an exemplary embodiment of the present invention.

It may be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the following detailed description, only certain exemplary embodiments of the present invention have been shown and described, simply by way of illustration. As those skilled in the art would realize, the described embodiments may be modified in various different ways, all without departing from the spirit or scope of the present invention.

Furthermore, in the exemplary embodiments, since like reference numerals designate like elements having the same configuration, various exemplary embodiments is representatively described, and in other exemplary embodiments, only a configuration different from the various exemplary embodiments will be described.

It shall be noted that the drawings are schematic and do not depict exact dimensions. The relative proportions and ratios of elements in the drawings may be exaggerated or diminished in size for the sake of clarity and convenience in the drawings, and such arbitrary proportions are only illustrative and not limiting in any way. Like reference numerals are used for like structures, elements, or parts shown in two or more drawings to show similar characteristics. When one part is said to be "over" or "on" another part, the one part may be directly over the other part or may be accompanied by another part interposed therebetween.

Exemplary embodiments of the present invention specifically show exemplary embodiments of the present invention. As a result, various modifications of the drawings are anticipated. Accordingly, the exemplary embodiments are not limited to certain forms of the regions illustrated, but may include forms that are modified through manufacturing, for example.

Hereinafter, a muffler including a muffler valve device for a vehicle according to an exemplary embodiment of the present invention will be described in detail with reference to FIG. 1.

Referring to FIG. 1, a muffler valve device for a vehicle according to an exemplary embodiment of the present invention 100 includes basically space portions 14*a*, 14*b*, 14*c*, and 14*d* which have a certain size divided by internal walls 12, and is applied to internal to the muffler 10 which exhaust gas inflows from an inflow pipe 18 and the exhaust gas outflows through a tail pipe 22 which protrudes toward outside.

The exhaust gas in the muffler 10 flows between the space portions 14*a*, 14*b*, 14*c* and 14*d* divided by holes formed on the walls 12, and the exhaust gas may flow from the space portion 14*d* to the space portion 14*c* through the muffler valve device 100 according to a pressure of the exhaust gas.

The muffler valve device 100 may be disposed on the wall 12 disposed at a side of the tail pipe 22, and the muffler valve device 100 may be disposed in the space portion 14*c*. The exhaust gas may move from the space portion 14*d* to the space portion 14*c* through the wall 12 on which the muffler valve device 100 is disposed. Accordingly, the exhaust gas flows through the walls 12 according to pressure of the exhaust gas inflowed into the muffler 10 through the inflow pipe 18 to pressurize the muffler valve device 100, and opening or closing amount of the muffler valve device 100 is adjusted, therefore flow amount of the exhaust gas flowing from the space portion 14*d* to the space portion 14*c* may be adjusted.

Hereinafter, a muffler valve device for a vehicle according to an exemplary embodiment of the present invention will be described in detail with reference to FIG. 2 to FIG. 3.

Figure 2:
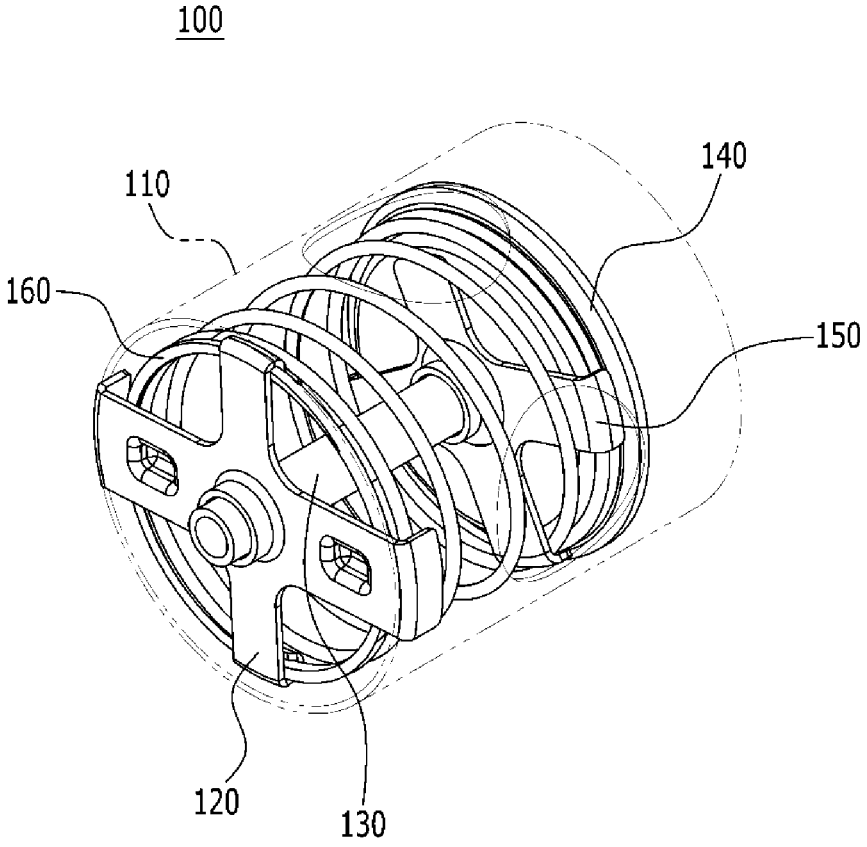
FIG. 2 is a perspective view of an internal structure of the muffler valve device for a vehicle according to an exemplary embodiment of the present invention.
Figure 3:
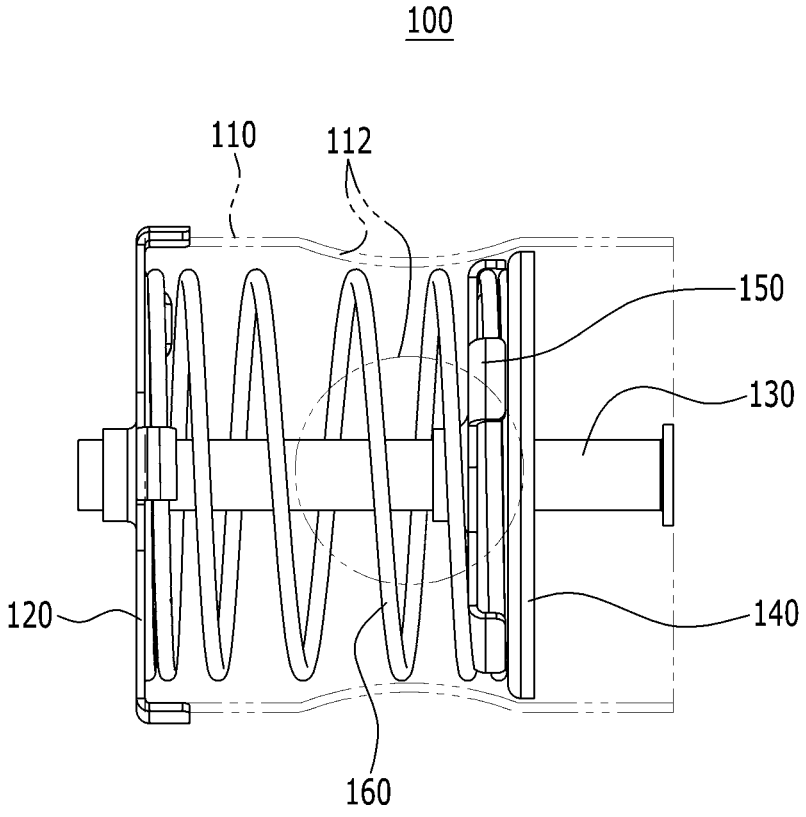
FIG. 3 is a front view of the muffler valve device illustrated in FIG. 2.

FIG. 2 is a perspective view of an internal structure of the muffler valve device for a vehicle according to an exemplary embodiment of the present invention, and FIG. 3 is a front view of the muffler valve device illustrated in FIG. 2.

Referring to FIG. 2 and FIG. 3, the muffler valve device for a vehicle 100 according to an exemplary embodiment of the present invention includes a chamber 110, a guide rod 130, a fixing member 120, a valve 140, and an elastic member 160.

The chamber 110 is fixed at a surface of the wall 12 dividing the space portion 14*c* and the space portion 14*d*, and is disposed in the space portion 14*c*. The chamber 110 includes exhaust gas exhausting holes 112 on an external circumference, and the exhaust gas exhausting hole 12 may be formed as a plural and spaced at a predetermined interval along the external circumference of the chamber 110.

The guide rod 130 is provided in the chamber 110 and attached at the surface of the wall 12.

The chamber 110 may be formed as a hollow cylinder shape, and the guide rod 130 may be provided to penetrate a center of the hollow of the chamber 110 in a lengthwise direction of the chamber 110. The guide rod 130 may be formed as a circular cylinder shape.

The fixing member 120 is attached at one end portion of the guide rod 130 and fixes the chamber 110.

The valve is disposed slidably along the guide rod 130 between the surface of the wall 12 and the fixing member 120. The valve 140 may be formed as a circular plate shape corresponding to a shape of the chamber 110, and a hole into which the guide rod 130 is inserted may be formed on a center portion.

One surface of the valve 140 contacts directly with the exhaust gas inflowing from a side of the wall 12, and moves slidably on the guide rod 130 toward the fixing member 120.

The elastic member 160 is located between the valve 140 and the fixing member 120 to provide an elastic force to the valve 140. The elastic member 160 may be a coil spring of which one end portion is supported by the fixing member 120 and the other end portion is supported by the valve 140.

Meanwhile, the muffler valve device 100 according to an exemplary embodiment of the present invention may further include a plate 150. The plate 150 may be attached on the valve 140 to fix the elastic member 160 to the valve 140 and disposed slidably on the guide rod 130.

Figure 4:
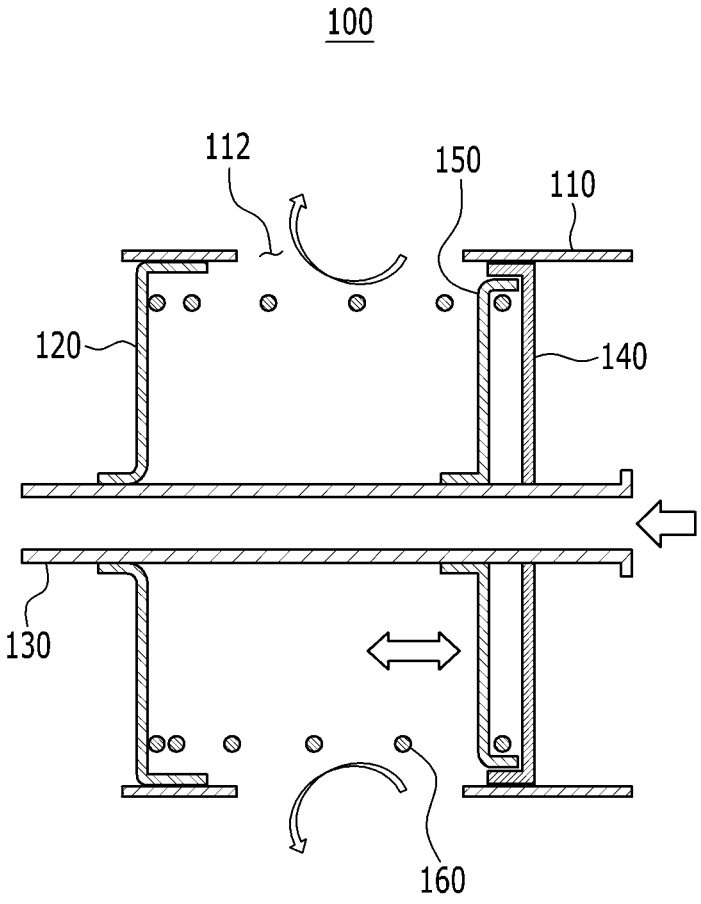
FIG. 4 is a cross-sectional view of operational state of the muffler valve device according to an exemplary embodiment of the present invention.

FIG. 4 is a cross-sectional view of operational state of the muffler valve device according to an exemplary embodiment of the present invention.

The exhaust gas inflowing form the space portion 14*d* to the space portion 14*c* through the wall 12 pressurizes the valve 140 in the chamber 110, and when the pressure becomes greater than the elastic force of the elastic member 160, the valve 140 moves slidably toward the fixing member 120.

The valve 140 moves slidably, therefore the exhaust gas exhausting hole 112 formed at the external circumference of the chamber 110 and a space at a side of the surface on which exhaust gas of the valve 40 contacts are connected to each other. Accordingly, the exhaust gas is exhausted from the side of the surface-contacting with the exhaust gas to the exhaust gas exhausting hole 112.

When the pressure of the exhaust gas becomes small, the valve 140 moves slidably toward the wall 12 by the elastic force of the elastic member 160, and the exhaust gas exhausting hole 112 and the space at the side of the surface on which exhaust gas contacts are not connected to each other.

In a low RPM region which pressure of the inflowed exhaust gas is smaller than the elastic force of the elastic member 160, the exhaust gas is not connected to the exhaust gas exhausting hole 112, and in a high RPM region which pressure of the inflowed exhaust gas is greater than the elastic force of the elastic member 160, the exhaust gas flows into the space portion 14*c* through the exhaust gas exhausting hole 112, therefore the booming sound and the flow-induced noise may be reduced. Furthermore, the exhaust gas flows uniformly and expectably regardless of RPM to improve engine output.

Figure 5A:
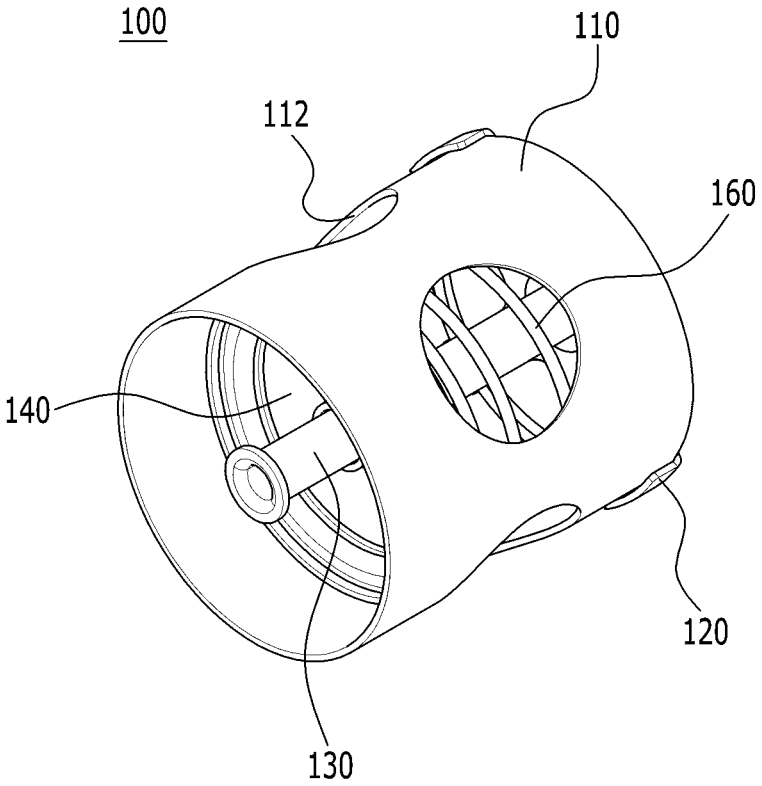
FIG. 5A, FIG. 5B, FIG. 5C, FIG. 5D and FIG. 5E are perspective views illustrating the muffler valve device according to an exemplary embodiment of the present invention in various angles.
Figure 5B:
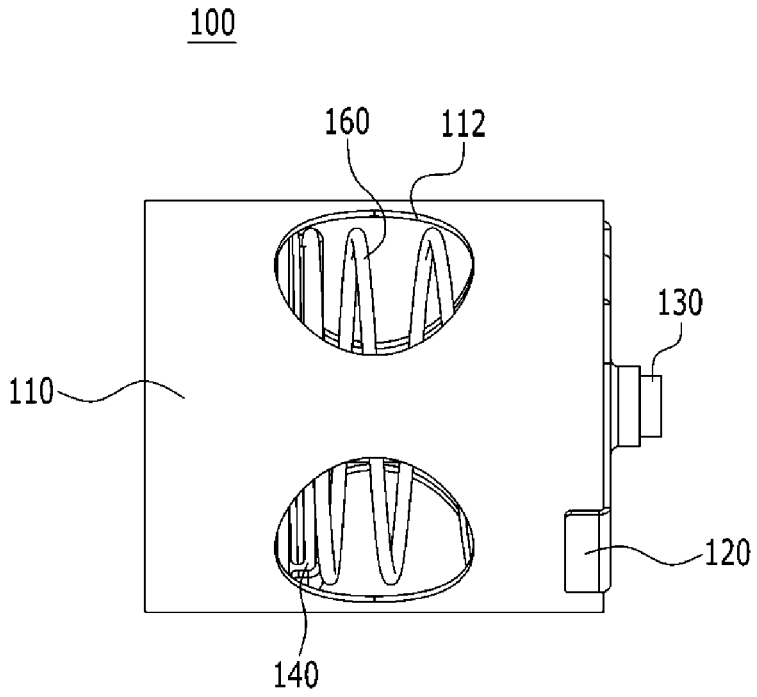
Figure 5C:
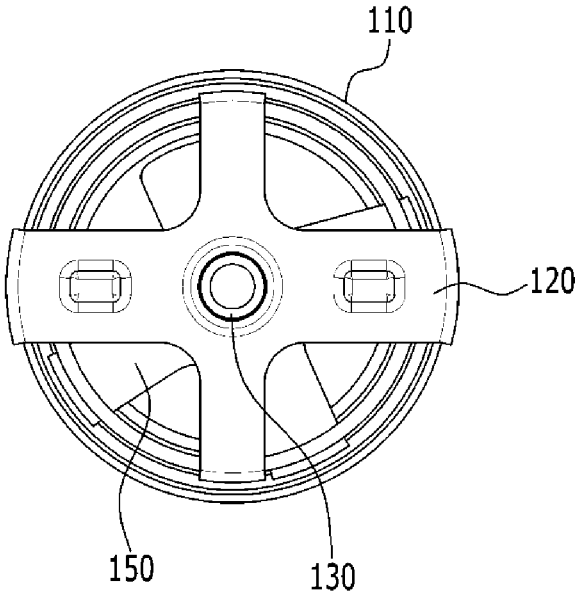
Figure 5D:
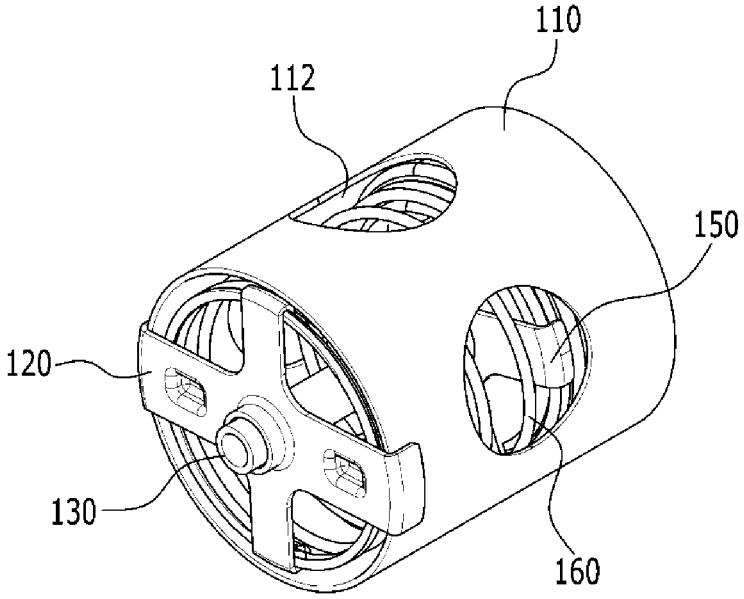
Figure 5E:
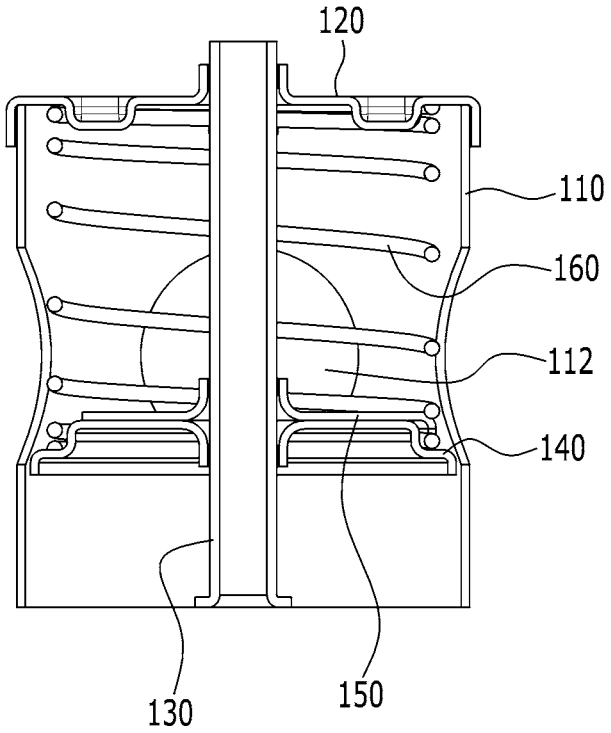
Figure 6:
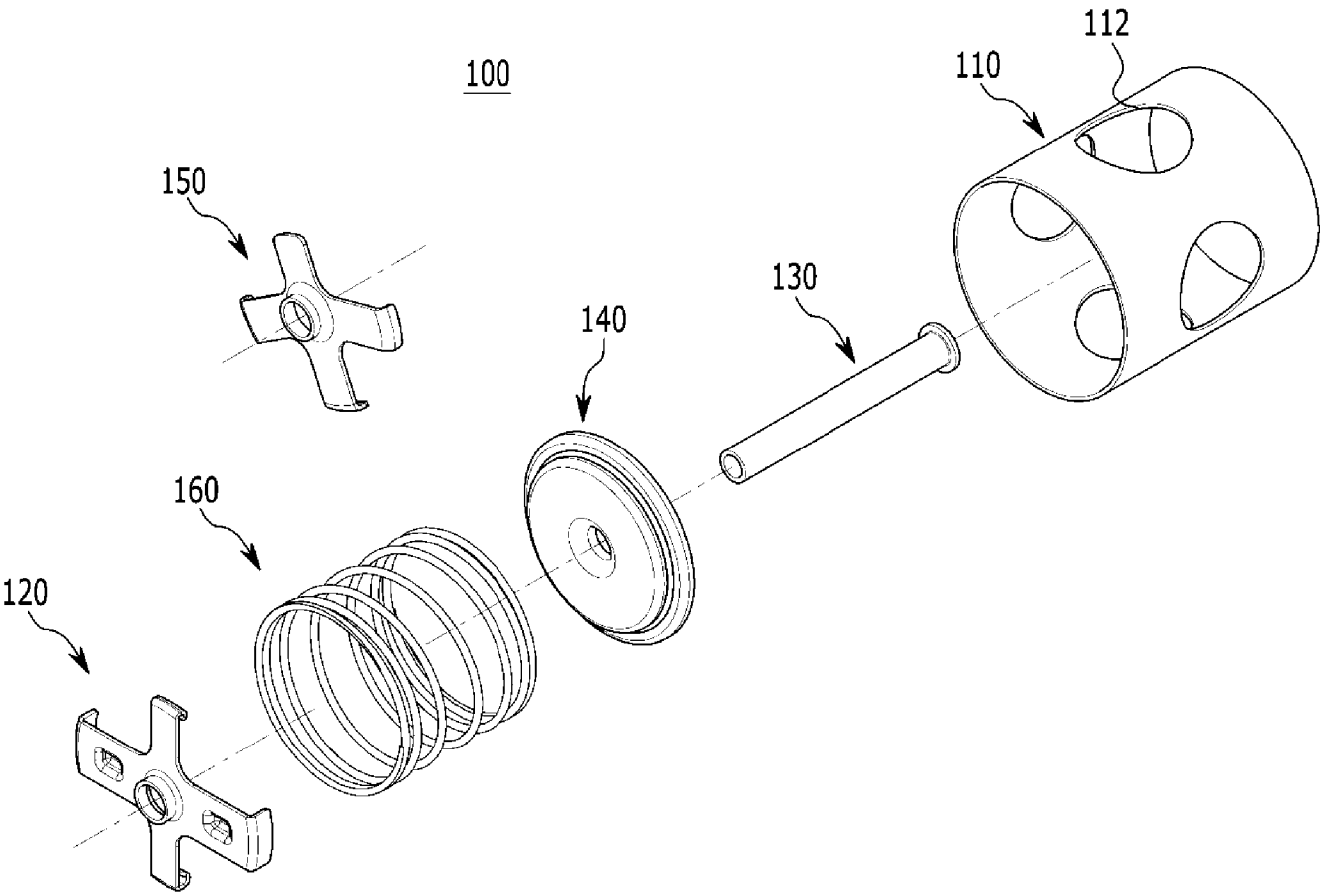
FIG. 6 is an exploded perspective view of the muffler valve device according to an exemplary embodiment of the present invention.

FIG. 5A, FIG. 5B, FIG. 5C, FIG. 5D and FIG. 5E are perspective views illustrating the muffler valve device according to an exemplary embodiment of the present invention in various angles, and FIG. 6 is an exploded perspective view of the muffler valve device according to an exemplary embodiment of the present invention.

Referring to FIG. 5A to FIG. 6, the chamber 110 may include four exhaust gas exhausting holes 112 formed at a center portion to be spaced at a predetermined interval along the external circumference of the chamber 110. In the exemplary embodiment of the present invention, it is shown that the respective exhaust gas exhausting hole 112 is formed to be spaced at a predetermined interval along the external circumference of the chamber 110, however, it should be understood that the present invention is not limited thereto. The number, size and location on the circumference of the chamber 110 may be modified and applied.

The guide rod 130 is provided to penetrate the center portion of the internal to the chamber 110, and the center portion of the fixing member 120 is attached to one end portion of the guide rod 130. The fixing member 120 may be formed to have larger diameter than that of the chamber 110 to fix the chamber 110.

Furthermore, valve 140 is provided at an opposite side of the fixing member 120, and the plate 150 is provided at the valve 140.

Meanwhile, the fixing member 120 may be formed as a plurality of perpendicular rods extending toward outside on a center of a portion on which the guide rod 130 is attached. By the present shape of the fixing member 120, entire weight of the muffler valve device 100 may be reduced. Furthermore, an end portion of the fixing member 120 may be formed as being bent toward the chamber 110 and the elastic member 160, therefore the end portion of the fixing member 120 may grip and fix the circumference of the chamber 110.

A portion of the fixing member 120 may fix the chamber 110, and the other portion may fix the elastic member 160. An end portion of the fixing member 120 which fixes the elastic member 160 may be formed as being bent toward the elastic member 160, therefore the end portion of the fixing member 120 may grip and fix the outside of the elastic member 160.

Diameter of the valve 140 is formed smaller than that of the chamber 110, a hole is formed at a center portion of the valve 140, and the valve 140 may move slidably by the guide rod 130.

Similar to the shape of the fixing member 120, the plate 150 may be shaped as a plurality of perpendicular rods extending toward outside on a center of a hole into which the guide rod 130 is inserted. By the present shape of the plate 150, entire weight of the muffler, valve device 100 may be reduced.

An end portion of the plate 150 is formed as being bent toward the valve 140 to fix the outside of the elastic member 160 by located between the elastic member 160 between the valve 140 and the plate 150.

The chamber 110, the guide rod 130, the fixing member 120, the valve 140 and the plate 150 may be formed of stainless steel material.

One end portion and the other end portion of the elastic member 160 are respectively fixed by the fixing member 120 and the plate 150, and the elastic member 160 may repeat compression and decompression between the fixing member 120 and the plate by sliding moving of the valve 140 and the plate 150. The elastic member 160 may be a coil spring and formed of Inconel material.

Like this, according to an exemplary embodiment of the present invention, flowing of exhaust gas according to pressure of the exhaust gas exhausted from an engine is adjusted to enhance the engine output and reduce booming noise and flow-induced noise, therefore the structure becomes simple and manufacturing cost may be reduced.

For convenience in explanation and accurate definition in the appended claims, the terms "upper", "lower", "internal", "outer", "up", "down", "upper", "lower", "upwards", "downwards", "front", "rear", "back", "inside", "outside", "inwardly", "outwardly", "internal", "external", "internal", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A muffler valve device of a vehicle for improving output of an engine, reducing a booming sound, and minimizing flow-induced noise, which is disposed at a wall of a plurality of walls provided at a muffler which exhaust gas inflows through an inlet pipe and outflows the inflowed exhaust gas through a tail pipe, the muffler valve device comprising:

a chamber fixed at a surface of the wall;

a guide rod provided in the chamber and attached at the surface of the wall;

a fixing member attached at a first end portion of the guide rod and being mounted to an end of the chamber;

a valve disposed slidably on the guide rod between the surface of the wall and the fixing member; and an elastic member located between the valve and the fixing member to provide an elastic force to the valve, wherein the fixing member is formed as a plurality of perpendicular rods extending toward outside on a center of a portion on which the guide rod is attached, wherein an end portion of the fixing member is formed as being bent toward the chamber and the elastic member, and wherein a first portion of the fixing member fixes the chamber, and a second portion thereof fixes the elastic member.

2. The muffler valve device of claim 1, wherein the chamber has at least one exhaust gas exhausting hole formed on an external circumference between the fixing member and the valve.

3. The muffler valve device of claim 2, wherein a respective exhaust gas exhausting hole of the at least one exhaust gas exhausting hole is formed spaced at a predetermined interval along the external circumference of the chamber.

4. The muffler valve device of claim 1, wherein the chamber is formed as a hollow cylinder shape to form a hollow, and the guide rod penetrates a center of the hollow of the chamber in a longitudinal direction of the chamber.

5. The muffler valve device of claim 1, wherein the elastic member is a coil spring of which a first end portion is supported by the fixing member and a second end portion is supported by the valve.

6. The muffler valve device of claim 5, wherein the elastic member is formed of Inconel material.

7. The muffler valve device of claim 1, further including:

a plate attached on the valve to fix the elastic member to the valve and disposed slidably on the guide rod.

8. The muffler valve device of claim 7, wherein the plate is shaped as a plurality of perpendicular rods extending toward outside on a center of a hole into which the guide rod is inserted.

9. The muffler valve device of claim 7, wherein an end portion of the plate is formed as being bent toward the valve to fix the elastic member.

10. The muffler valve device of claim 7, wherein the chamber, the guide rod, the fixing member, the valve and the plate are formed of stainless steel material.

* * * * *